US008474204B2

(12) United States Patent
Pan et al.

(10) Patent No.: US 8,474,204 B2
(45) Date of Patent: Jul. 2, 2013

(54) ARCHITECTURED REINFORCEMENT STRUCTURE

(75) Inventors: Chan-Ping Pan, Taipei (TW); Chao-Lung Hwang, Taipei (TW); Chung-Chuan Chang, Taipei (TW); Yu-Hsien Chiang, Taipei (TW)

(73) Assignee: National Taiwan Univeristy Of Science And Technology, Taipei (TW)

( * ) Notice: Subject to any disclaimer, the term of this patent is extended or adjusted under 35 U.S.C. 154(b) by 93 days.

(21) Appl. No.: 13/190,637

(22) Filed: Jul. 26, 2011

(65) Prior Publication Data

US 2012/0304584 A1 Dec. 6, 2012

(30) Foreign Application Priority Data

Jun. 1, 2011 (TW) ..... 100118894 A

(51) Int. Cl.
*E04B 1/16* (2006.01)
*E04H 12/12* (2006.01)

(52) U.S. Cl.
USPC ..... 52/259; 52/650.1

(58) Field of Classification Search
USPC ..... 52/845, 843, 223.9, 223.12, 223.8, 52/505, 651.07, 651.1, 650.1, 649.3, 649.2, 52/649.1, 259, 258
See application file for complete search history.

(56) References Cited

U.S. PATENT DOCUMENTS

| | | | | |
|---|---|---|---|---|
| 2,936,051 | A * | 5/1960 | Martin | 52/694 |
| 4,231,198 | A * | 11/1980 | Augier et al. | 52/91.2 |
| 4,409,764 | A * | 10/1983 | Wilnau | 52/127.3 |
| 5,205,101 | A * | 4/1993 | Swan et al. | 52/650.1 |
| 5,263,297 | A * | 11/1993 | Kim | 52/834 |
| 5,584,156 | A * | 12/1996 | Lange | 52/653.1 |
| 5,678,375 | A * | 10/1997 | Juola | 52/655.1 |
| 2008/0295424 | A1* | 12/2008 | Crosbie | 52/223.11 |

* cited by examiner

*Primary Examiner* — Christine T Cajilig

(57) ABSTRACT

This invention presents a modified reinforced concrete structure, which has a steel structure composed of a beam steel box unit, column steel box unit, and beam-column joint steel box unit with lap jointing reinforced steels. The side plate and/or end plate of the steel box has through holes for concrete flowing therebetween. In this way, the workability of concrete grouting and tamping are improved, and the phenomena of hive, segregation, or floating can be avoided. It can also enhance the performance of beam-column joints (e.g. with better confinement ability, etc.). Applying the invention, the efficiency and accuracy of constructing beam-column joints can be increased, and in addition to better ensure the structural safety, it can also reduce construction manpower and schedule.

10 Claims, 8 Drawing Sheets

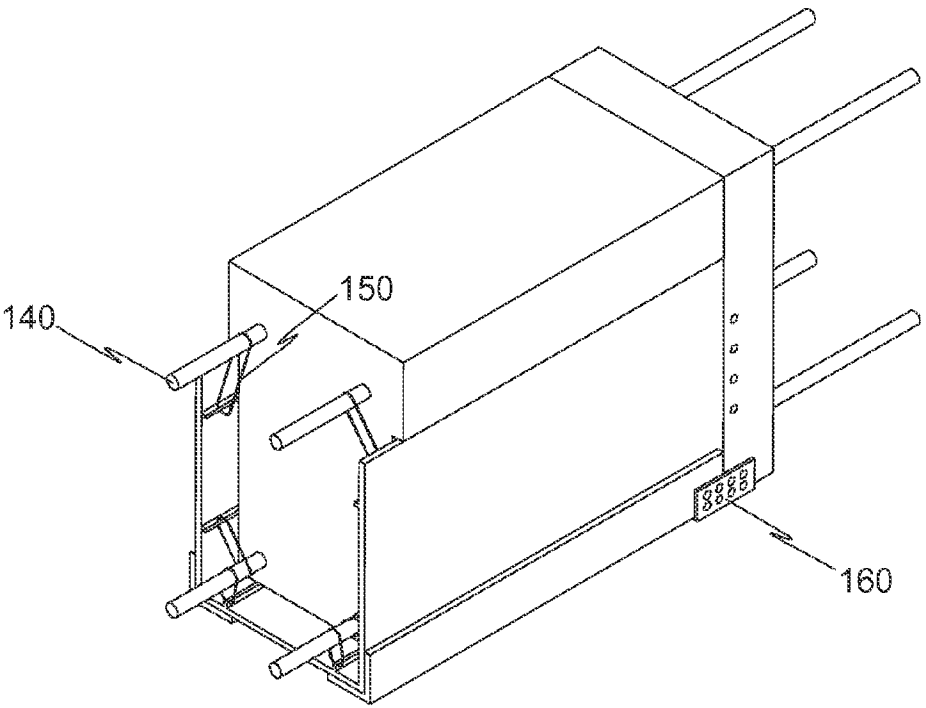
FIG. 2B
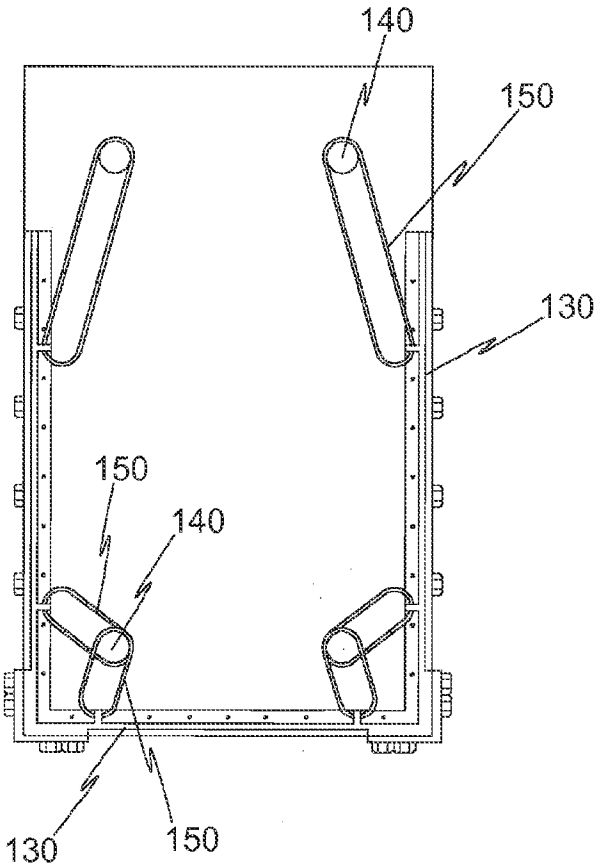

ARCHITECTURED REINFORCEMENT STRUCTURE

CROSS-REFERENCE TO RELATED APPLICATION

This application claims foreign priority from a Taiwan Patent Application, Ser. No. 100118894, filed on Jun. 1, 2011.

BACKGROUND OF INVENTION

1. Field of Invention

This invention relates to a modified reinforced concrete structure, which has less than 4% cross-section area ratio of steel, thus is referred as a modified reinforced concrete structure with respect to conventional SRC structure.

2. Description of the Prior Art

With the development of various construction materials and applications, the modern architecture has various diversities, in which the walls of the building structure, floor structure also have a lot varieties. Such varieties of wall and floor structures facilitate the building designers, and constructors to select the appropriate wall plate with an appropriate unit weight, compressive strength, lateral tensile strength in construction, and then consider the suitability of the construction costs, so that the design of buildings can be more convenient and flexible.

In conventional reinforced concrete structures, only simple overlap is used between steel or wire binding, and there is no ability to transfer stress between the two but alone concrete bonding. Before concrete grouting, safety supports are required to sustain the steel structure, thus leads to a messy construction site and steel construction can not achieve the accuracy and standards. And it is often result in inaccuracy of protective layer thickness, lack of reinforcement spacing, or short of numbers of stirrups in joints, and such defects usually cause failure after the earthquake occurred. The reinforcement without bonding strength often buckles and fails when encountering ultimate strength limitation. The core concrete cannot be confined and extend the cross-sectional strength, thus results in brittle damage.

The current combination of a variety of conventional steel structural wall, floor, or roof does not require setting up mold plates, and does not need to wait for the curing of concrete. It has the advantages such as high construction speed, easy to control the construction progress, thus is widely applied for the architecture engineering, as well as for modern ultra-high-rise buildings. However, it still has following shortcomings.

When constructing steel structure of particular structural steel design, the components of the structure should be "tailor-made," and a special manufacturing line should be arranged. Unlike general building materials, those particular structural steel design lack practicability and progressiveness.

Particular structural steel or building materials of particular shapes are not for widespread use. The size of a particular design or manufacture of building materials required to open an individual molds, resulting in increase of the overall costs.

The production of structural components should be set up additionally, and there is usually no spare production line. Therefore once the production is delayed, it will affect the construction progress. And once the production is over the requirement, it will cause the waste of discarded building materials.

Because of structural construction is different from the pre-assembled composite wall or floor, the constructor should assemble the composite wall or floor of particular design according to construction drawing. If constructors are not familiar with, or negligence, or misunderstanding the case of construction drawings, the construction efficiency and the quality are of great concerned. It may seriously affect the quality of construction and completion on schedule.

Therefore, the conventional combination of rigid frame structure, the assembly structure of floor and construction method still need for improvement.

SUMMARY OF INVENTION

In view of above, the present invention provides an architectured reinforcement structure, which is composed of a plurality of interconnected steel box units. Through various design of the side plates and end plates of the steel box unit, the steel box unit can be configured as a beam steel box unit, a column steel box unit, and a beam/column joint steel box unit. And with the interconnection in the X direction, the Y direction, and the Z direction, the architectured reinforcement structure of a building is constructed.

Accordingly, by implementing the architectured reinforcement structure of the present invention, the construction of the concrete structure reinforced by steel frame can be improved, and the connection of the beams and columns can have advantages as follows:

The grouting and tamping of concrete construction is improved, and the phenomena such as hive, segregation, and bleeding can be reduced.

The ability of beam-column joint is improved, for example, the ability of confinement is improved.

Increase the beam-column joint construction speed, convenience, and accuracy.

In addition to better ensure the structural safety, but also saves manpower and schedule.

The present invention provides an architectured reinforcement structure, comprising a plurality of interconnected steel box units, wherein each steel box unit comprises two end plates being disposed at both ends of the steel box unit, each one of the end plates comprises an end plate central opening located at the central region of the end plate and a plurality of end plate peripheral openings located at the peripheral region of the end plate; at least two angle steel bars being disposed between the two end plates and respectively attached thereto, and positioned on side edges of the steel box unit in the direction parallel to a longitudinal axis of the steel box unit; and, at least three side plates being disposed between the two end plates, and configured as lateral planes of the steel box unit by the angle steel bars.

According to one aspect of the invention, the angle steel bar is attached to the end plate further by an angle steel bar connecting piece.

According to one aspect of the invention, the end plate comprises at least a flange perpendicularly protruding the surface circumference of the end plate. And the architectured reinforcement structure of the invention further comprises a joint sleeve configured to inset into the flange of the end plate for joining the end plates of the two adjacent steel box unit, wherein the two adjacent steel box units are joined together by means of welding the joint sleeve with the adjacent end plates in a full-penetration weld manner.

According to one aspect of the invention, the architectured reinforcement structure of the invention further comprises a plurality of reinforcing steel bars, passing through the end plate peripheral openings and extending outwardly from the steel box unit, respectively, wherein the reinforcing steel bar extending out from the end plate peripheral openings can be anchored on an outer surface of the end plate.

According to one aspect of the invention, the side plate further comprises a side plate central opening located at the central region of the side plate, and a plurality of side plate peripheral openings surrounding the side plate central opening, wherein the steel box unit further comprises a plurality of reinforcing steel bars, passing through the side plate peripheral openings and extending outwardly from the steel box unit, respectively. The reinforcing steel bar passing through the side plate peripheral opening can be anchored on an outer surface of the side plate.

According to one aspect of the invention, the steel box unit further comprises a plurality of steel rings, which are hung on the side plate for hooking the reinforcing steel bar.

According to one aspect of the invention, the side plate is a grid steel plate.

By interconnecting multiple steel box units according to the architectured reinforcement structure of the present invention in the X direction, the Y direction, and the Z direction respectively, the architectured reinforcement structure of a building can be constructed.

BRIEF DESCRIPTION OF THE DRAWINGS

The embodiments will be described in detail with reference to the following drawings in which like reference numerals refer to like elements wherein:

FIGS. 2A-2C illustrate an embodiment of a beam steel box unit of an architectured reinforcement structure of the present invention;

DETAILED DESCRIPTION

Figure 1A:
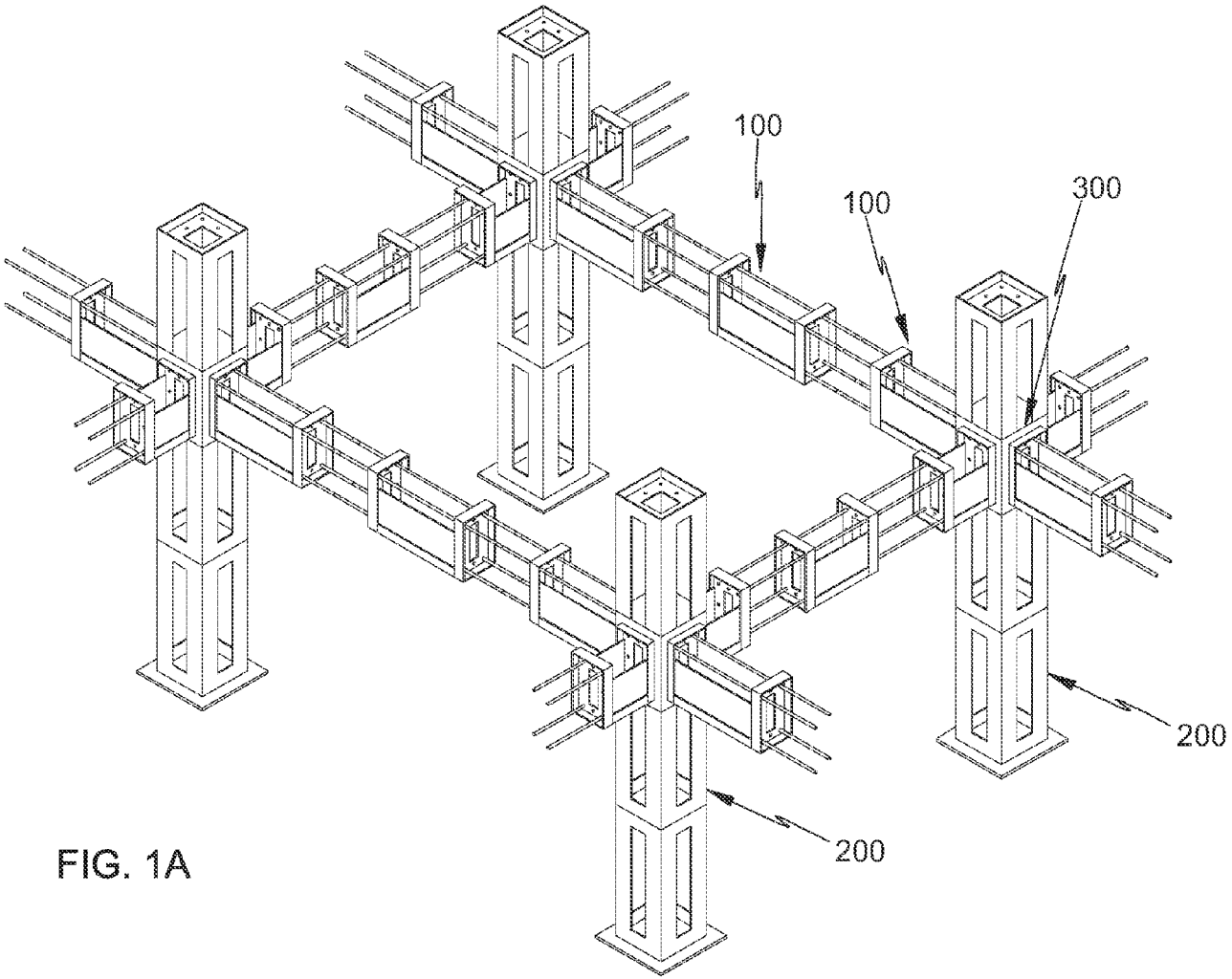
FIGS. 1A and 1B illustrate an embodiment of an architectured reinforcement structure of the present invention.

Referring to FIG. 1A, the present invention presents an architectured reinforcement structure, which is composed of a plurality of interconnected steel box units. According to the present invention, a steel box unit is designed to have various side plates and end plates, so that the steel box unit can be formed as a beam steel box unit 100, a column steel box unit 200, and a beam-column joint steel box unit 300. By interconnecting plural beam steel box unit 100, column steel box unit 200, and beam-column joint steel box unit 300 in the X direction, the Y direction, and the Z direction, an architectured reinforcement structure as shown in FIG. 1A can be provided.

Figure 2A:
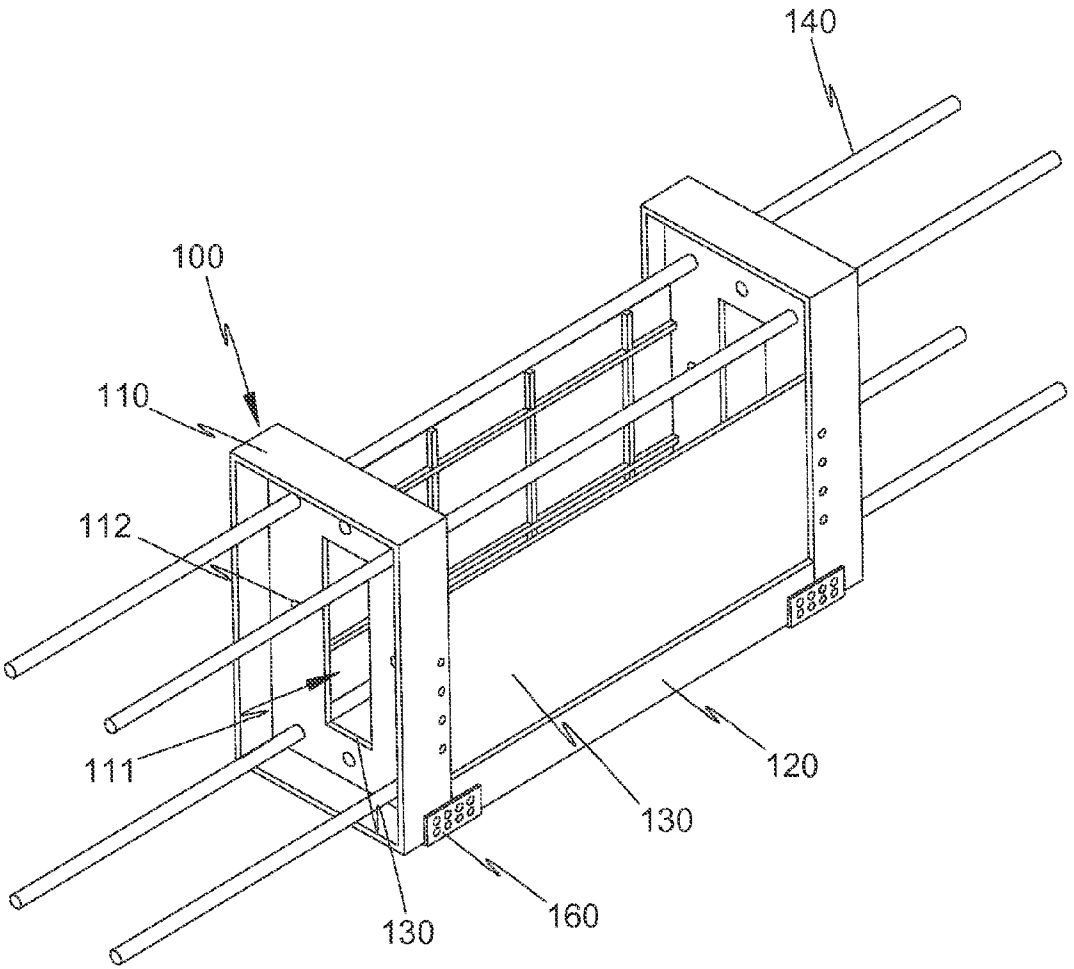
Figure 2C:
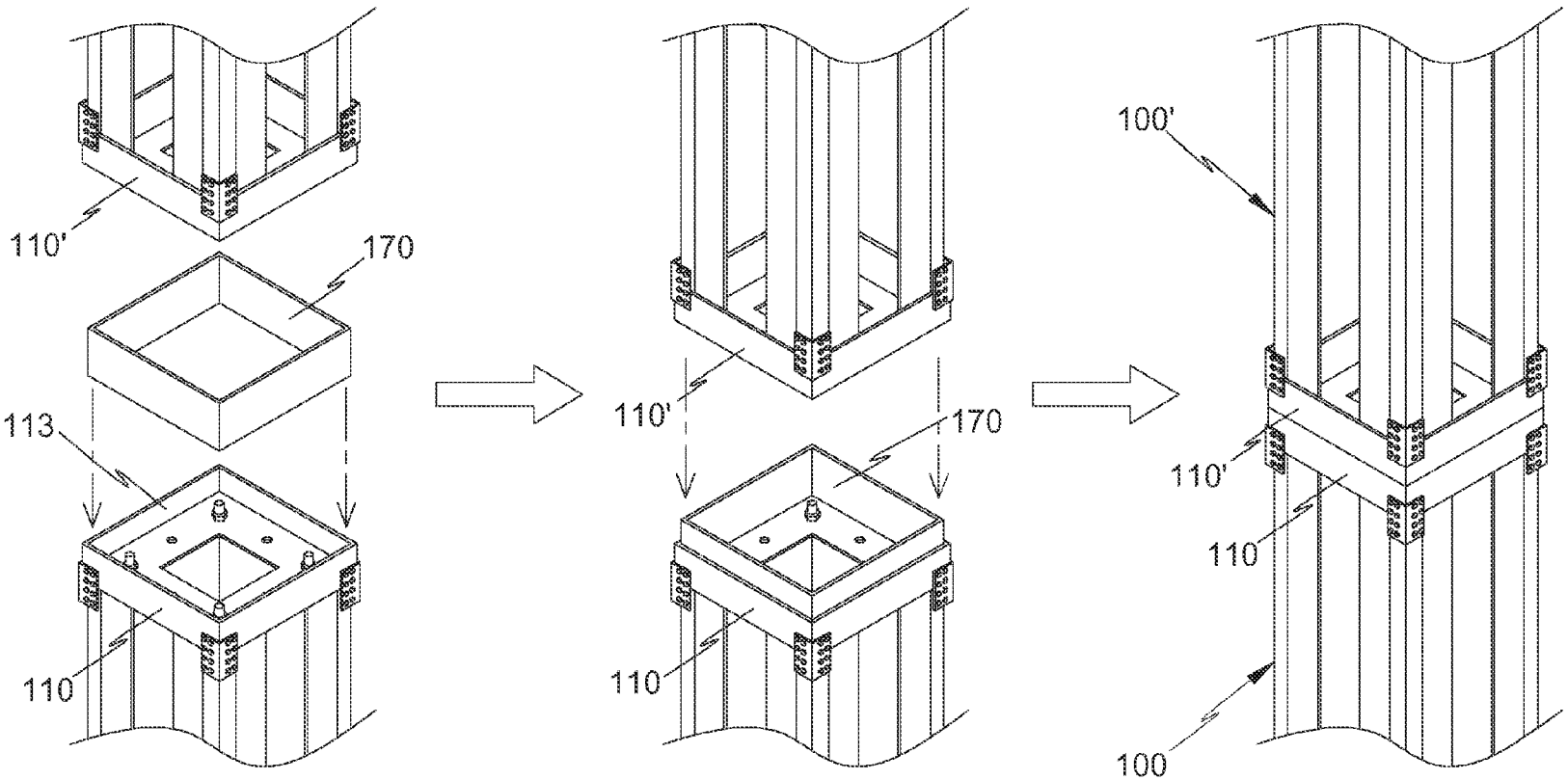

Refer to FIGS. 2A-2C. FIGS. 2A-2C illustrate an embodiment of a beam steel box unit of an architectured reinforcement structure of the present invention. A beam steel box unit 100 includes two end plates 110, two angle steel bars 120, three side plates 130, reinforcing steel bars 140, and steel rings 150, as shown in FIG. 2A.

The two end plates 110 are disposed at both ends of the beam steel box unit 100. The end plate 110 comprises an end plate central opening 111, which is located at the central region of the end plate 110, and a plurality of end plate peripheral openings 112, which are located at the peripheral region of the end plate 110. The aperture size of the end plate central opening 111 is configured to allow concrete to flow through during grouting.

The two angle steel bars 120 are disposed between the two end plates 110 and respectively attached to the two end plates 110. And, the two angle steel bars 120 are positioned on side edges of the beam steel box unit 100 in the direction parallel to a longitudinal axis of the beam steel box unit 100.

The three side plates 130 are disposed between the two end plates 110, and configured as lateral planes of the beam steel box unit 100 by the angle steel bars 120. By assembling two end plates 110, two angle steel bars 120, and three side plates 130, a box frame is formed to provide not only an over-wrapped steel structure for a beam of a construction, but a systematic mold plate module when grouting concrete.

Figure 1B:
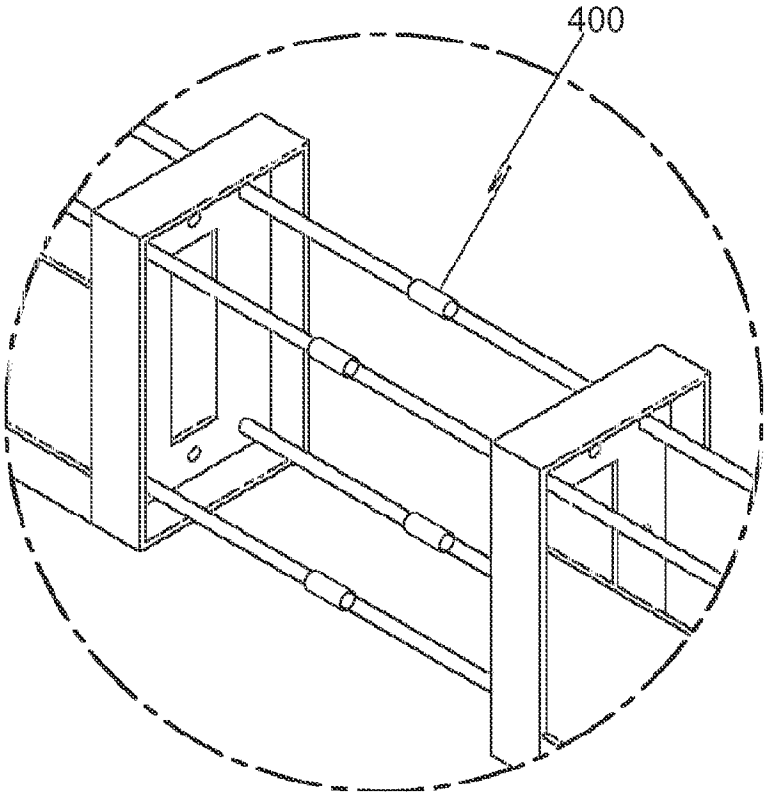

The reinforcing steel bar 140 passes through the end plate peripheral openings 112 of the beam steel box unit 100, and extends outwardly from the beam steel box unit 100. The portion of the reinforcing steel bar 140 protruding out of the end plate peripheral opening 112 not only can pass through adjacent beam steel box unit, but also can butt another corresponding reinforcing steel bar, e.g. directly butting by a steel bar connector 400, as shown in FIG. 1B, to extend the length required for the beam. Otherwise, the portion of the reinforcing steel bar 140 protruding out of the end plate peripheral opening 112 can be anchored on an outer surface of the end plate 110 by, for example, a T-headed anchor head.

As shown in FIG. 2B, the steel ring 150 can be hung on the side plate 130 and provided to hook the reinforcing steel bar 140, in order to fixedly position the reinforcing steel bar 140 in the beam and to maintain the spacing between the reinforcing steel bar 140 and the side plate 130. And, as the beam is under load, the steel ring 150 may also transfer the beam stress between the reinforcing steel bar 140 and the side plate 130.

The above-mentioned angle steel bar 120 may further connect to end plate 110 by an angle steel bar connecting piece 160. Moreover, referring to FIG. 2C, the end plate 110 includes at least a flange 113, protruding perpendicularly out from the circumference of the surface of the end plate 110. Thus, a joint sleeve 170 can be used to sheathe among flanges 113 of the end plate 110 for the beam steel box unit 100. And by means of a full-penetration weld manner to affix end plates 110, end plate 110' of the adjacent beam steel box units 100 with the joint sleeve 170, two adjacent beam steel box units 100 and 100' are connected. Additionally, the above-mentioned side plate 130 is a grid steel plate thereby the bond strength between the plate and the concrete is improved. Preferably, the above-mentioned side plate 130 is a perforated grid steel plate, thereby the weight of the plate is reduced and its strength and stiffness are improved.

Figure 3:
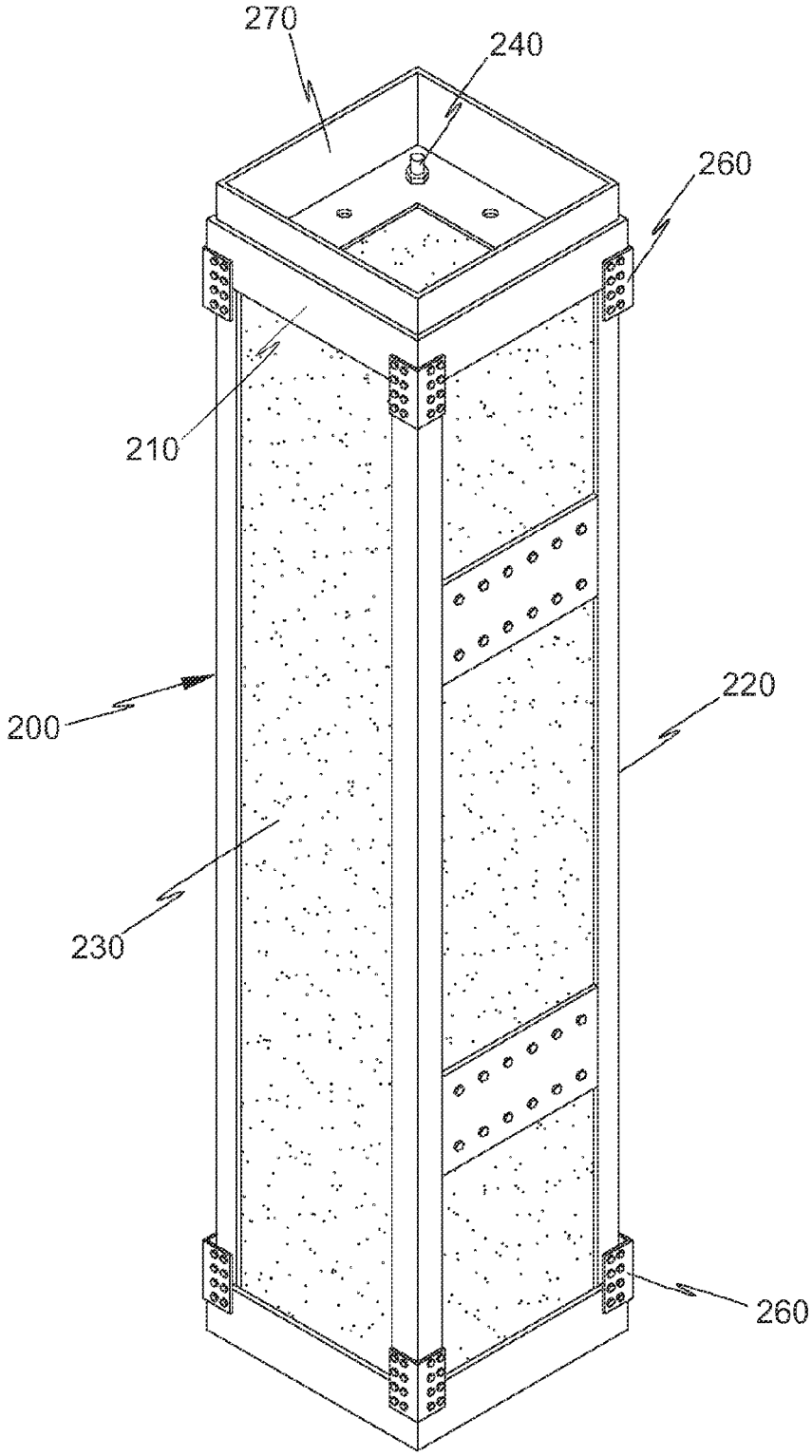
FIG. 3 illustrates an embodiment of a column steel box unit of an architectured reinforcement structure of the present invention.

Refer to FIG. 3. FIG. 3 illustrates an embodiment of a column steel box unit of an architectured reinforcement structure of the present invention. As the illustrated embodiment, the column steel box unit 200 includes two end plates 210, four angle steel bars 220, four side plates 230, reinforcing steel bars 240, and a steel ring 250 (not shown)

The two end plates 210 are disposed at both ends of the column steel box unit 200. The end plate 210 includes an end plate central opening 211 located at the central region of the end plate 210, and a plurality of end plate peripheral openings 212 located at the peripheral region of the end plate 210, wherein the aperture size of the end plate central opening 211 is configured to allow concrete to flow through during grouting.

The angle steel bars 220 are disposed between the two end plates 210 and respectively attached to the two end plates 210.

And, the angle steel bars 220 are positioned on side edges of the beam steel box unit 200 in the direction parallel to a longitudinal axis of the beam steel box unit 200.

The side plates 230 are disposed around sides of the column steel box unit 200, and assembled on two end plates 210 by the angle steel bars 220. By assembling two end plates 210, four angle steel bars 220, and four side plates 230, a box frame is formed to provide not only an over-wrapped steel structure for a column of a construction, but a systematic mold plate module when grouting concrete.

Figure 5B:
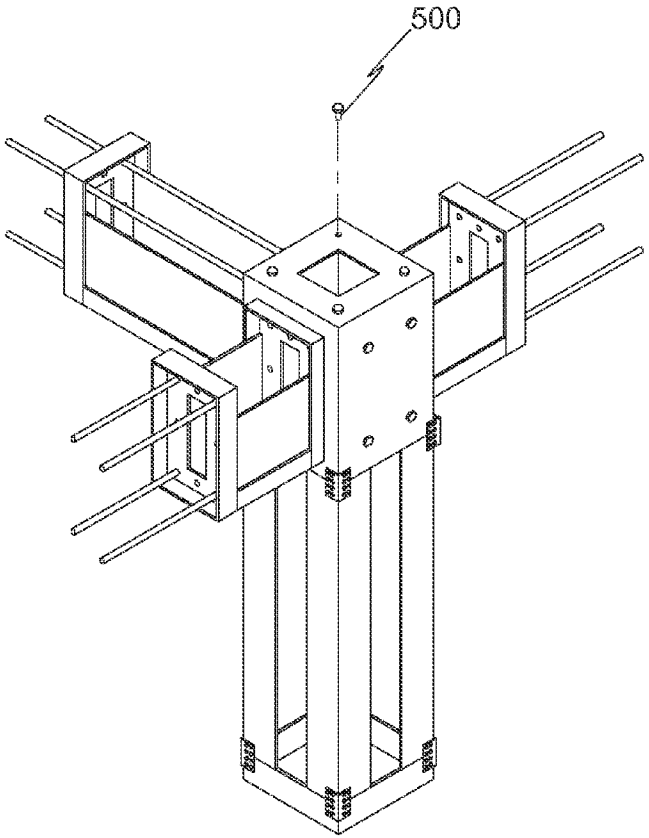
FIGS. 5A and 5B illustrate jointed multiple steel box units of the present invention.

The reinforcing steel bar 240 passes through the end plate peripheral openings 212 of the column steel box unit 200, and extends outwardly from the column steel box unit 200. The portion of the reinforcing steel bar 240 protruding out of the end plate peripheral opening 212 not only can pass through adjacent column steel box unit, but also can butt another corresponding reinforcing steel bar, e.g. directly butting by a steel bar connector 400, as shown in FIG. 1B, to extend the length required for the column. Otherwise, the portion of the reinforcing steel bar 240 protruding out of the end plate peripheral opening 212 can be anchored on an outer surface of the end plate 210 by, for example, a T-headed anchor head 500 as shown in FIG. 5B.

The steel ring 250 (not shown) can be hung on the side plate 230 and provided to hook the reinforcing steel bar 240, in order to fixedly position the reinforcing steel bar 240 in the column and to maintain the spacing between the reinforcing steel bar 240 and the side plate 230. And, as the column is under load, the steel ring 250 may also transfer the column stress between the reinforcing steel bar 240 and the side plate 230.

The above-mentioned angle steel bar 220 may further connect to end plate 210 by an angle steel bar connecting piece 260. Moreover, the end plate 210 includes at least a flange 213, protruding perpendicularly out from the circumference of the surface of the end plate 210. Thus, a joint sleeve 270 can be used to sheathe among flanges 213 of the end plate 210 for column steel box unit 200. And by means of a full-penetration weld manner to affix end plates 210 of the adjacent column steel box units 200 with the joint sleeve 270, the two adjacent column steel box units 200 are connected. Additionally, the above-mentioned side plate 230 is a grid steel plate thereby the bond strength between the plate and the concrete is improved. Preferably, the above-mentioned side plate 230 is a perforated grid steel plate, thereby the weight of the plate is reduced and its strength and stiffness are improved.

Figure 4C:
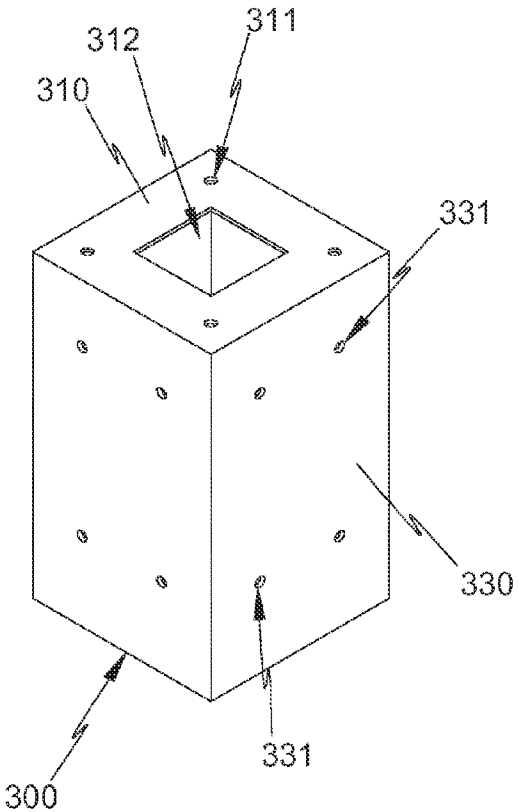
FIGS. 4A-4C illustrate an embodiment of connection between a beam column and a steel box unit of the present invention.
Figure 4B:
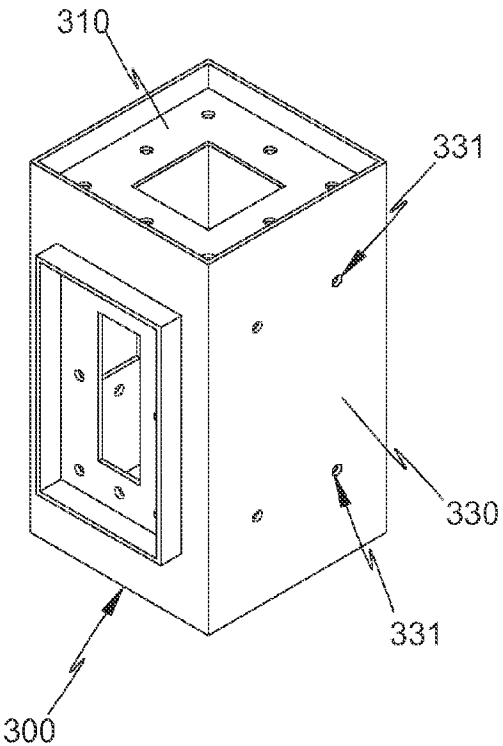
Figure 4A:
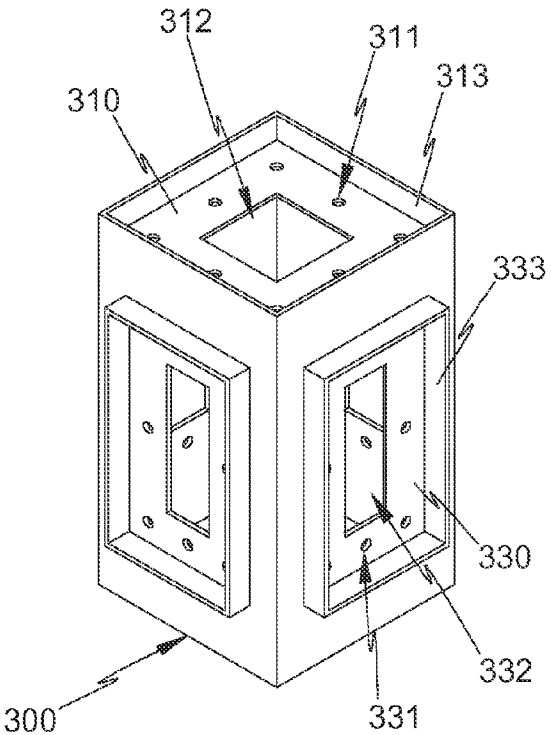

Refer to FIGS. 4A-4C. FIGS. 4A-4C illustrate an embodiment of connection between a beam column and a steel box unit of the present invention. The beam-column joint steel box unit 300 includes two end plates 310, and four side plates 330

The two end plates 310 are disposed at both ends of the beam-column joint steel box unit 300. As shown in FIG. 4A, based on the structure design, the end plate 310 includes an end plate central opening 311 located at the central region of the end plate 310, and a plurality of end plate peripheral openings 312 located at the peripheral region of the end plate 310. Wherein the aperture size of the end plate central opening 311 is configured to allow concrete to flow through during grouting, and the aperture size of the end plate peripheral openings 312 is configured to allow the above-mentioned reinforcing steel bar 240 of the column steel box unit 200 to pass through.

The four side plates 330 are attached to end plates 310, and are disposed around sides of the beam-column joint steel box unit 300. The side plate 330 can be alternatively designed based on the position of the architectured reinforcement structure of the present invention. In one aspect, as shown in FIG. 4A, the side plate 330 may include a side plate central opening 331 located at the central region of the side plate 330, and a plurality of side plate peripheral openings 332 located at the peripheral region of the end plate 330. Wherein the aperture size of the side plate central opening 331 is configured to allow concrete to flow through during grouting, and the aperture size of the side plate peripheral openings 332 is configured to allow the above-mentioned reinforcing steel bar 140 of the beam steel box unit 100 to pass through. In another aspect, as shown in FIGS. 4B and 4C, the side plate 330 may only include plural side plate peripheral openings 332, but not side plate central openings 331.

By assembling two end plates 310 and four side plates 330, a box frame is formed to provide not only an over-wrapped steel structure for a beam-column joint of a construction, but a systematic mold plate module when grouting concrete.

The above-mentioned end plate 310 can be alternatively designed based on the position of the architectured reinforcement structure of the present invention. The end plate 310 may include a flange 313, protruding perpendicularly out from the surface of the end plate 310. Thus, a joint sleeve 370 can be used to sheathe among flanges 313 of the end plate 310 for the beam-column joint steel box unit 300. And by means of a full-penetration weld manner to affix end plates 310 of the beam-column joint steel box unit 300 and the adjacent end plate 210 of the column steel box units 200 with the joint sleeve 370, the adjacent beam-column joint steel box unit 300 and column steel box unit 200 are connected together. In addition, the above-mentioned side plate 330 may also include a flange 333, protruding perpendicularly out from the surface of the side plate 330. Thus, a joint sleeve 370 can be used to sheathe among flanges 333 of the side plate 330 for the beam-column joint steel box unit 300. And by means of a full-penetration weld manner to affix side plate 330 of the beam-column joint steel box unit 300 and the adjacent end plate 110 of the beam steel box unit 100 with the joint sleeve 370, the adjacent beam-column joint steel box unit 300 and beam steel box unit 100 are connected together.

Figure 5A:
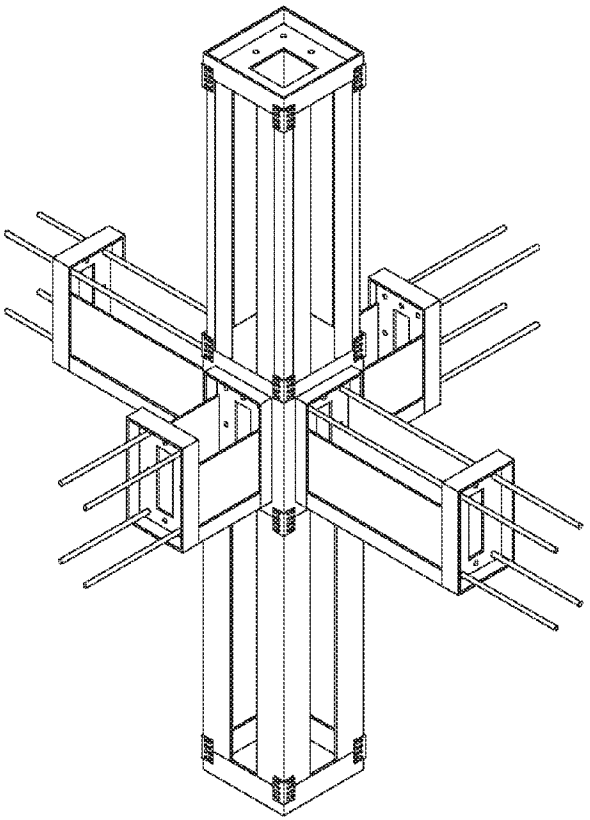

As stated above, by interconnecting multiple beam steel box units 100, column steel box units 200, and beam-column joint steel box units 300 in the X direction, the Y direction, and the Z direction respectively, the architectured reinforcement structure of the present invention as shown in FIGS. 5A and 5B can be provided. Furthermore, an architectured reinforcement structure of a building as shown in FIG. 1A can be constructed.

What has been described above includes examples of one or more embodiments. It is, of course, not possible to describe every conceivable combination of components or methodologies for purposes of describing the aforementioned embodiments, but one of ordinary skill in the art may recognize that many further combinations and permutations of various embodiments are possible. Accordingly, the described embodiments are intended to embrace all such alterations, modifications and variations that fall within the spirit and scope of the appended claims.

What is claimed is:

1. An architectured reinforcement structure, comprising:

a plurality of interconnected steel box units, wherein each steel box unit comprises:

at least three side plates, being connected to each other and forming to a box frame;

at least two angle steel bars, being disposed on the sides of the box frame for steadying the connections between the side plates; and two end plates, being disposed at the both ends of the box frame, and each of the end plates having an end plate central opening located at the central region of the end plate and a plurality of end plate peripheral openings located at the peripheral region of the end plate; and a concrete, being grouted into the box frame through the end plate central opening of one of the two ends plates.

2. The architectured reinforcement structure of claim 1, wherein the angle steel bar is attached to the end plate further by an angle steel bar connecting piece.

3. The architectured reinforcement structure of claim 1, wherein the end plate comprises at least a flange perpendicularly protruding the surface circumference of the end plate.

4. The architectured reinforcement structure of claim 3, further comprising a joint sleeve configured to inset into the flange of the end plate for joining the end plates of the two adjacent steel box units.

5. The architectured reinforcement structure of claim 4, wherein the two adjacent steel box units are joined together by means of welding the joint sleeve with the adjacent end plates in a full-penetration weld manner.

6. The architectured reinforcement structure of claim 1, wherein the steel box unit further comprises a plurality of reinforcing steel bars, passing through the end plate peripheral openings and extending outwardly from the steel box unit, respectively.

7. The architectured reinforcement structure of claim 6, wherein the reinforcing steel bar extending out from the end plate peripheral openings can be anchored on an outer surface of the end plate.

8. The architectured reinforcement structure of claim 1, wherein the side plate further comprises a side plate central opening located at the central region of the side plate, and a plurality of side plate peripheral openings surrounding the side plate central opening.

9. The architectured reinforcement structure of claim 8, wherein the steel box unit further comprises a plurality of reinforcing steel bars, passing through the side plate peripheral openings and extending outwardly from the steel box unit, respectively.

10. The architectured reinforcement structure of claim 6, wherein the steel box unit further comprises a plurality of steel rings, and each the steel ring being used for hanging on each the side plate and hooking each the reinforcing steel bar, so as to fixedly position the reinforcing steel bar in the beam and to maintain the spacing between the reinforcing steel bar and the side plate.

* * * * *